US008910670B2

(12) United States Patent
Tseng

(10) Patent No.: US 8,910,670 B2
(45) Date of Patent: Dec. 16, 2014

(54) X WEAVE OF COMPOSITE MATERIAL AND METHOD OF WEAVING THEREOF

(71) Applicant: Kai-Hsi Tseng, Changhua County (TW)

(72) Inventor: Kai-Hsi Tseng, Changhua County (TW)

( * ) Notice: Subject to any disclaimer, the term of this patent is extended or adjusted under 35 U.S.C. 154(b) by 135 days.

(21) Appl. No.: 13/765,089

(22) Filed: Feb. 12, 2013

(65) Prior Publication Data

US 2014/0227927 A1 Aug. 14, 2014

(51) Int. Cl.

| | |
|---|---|
| ***D03D 41/00*** | (2006.01) |
| ***D03D 9/00*** | (2006.01) |
| ***D03D 15/00*** | (2006.01) |
| *D03D 25/00* | (2006.01) |

(52) U.S. Cl.

CPC ..... *D03D 15/0088* (2013.01); *D03D 15/0011* (2013.01); *D03D 41/008* (2013.01)

USPC ..... 139/383 R; 139/384 R; 139/416

(58) Field of Classification Search

None

See application file for complete search history.

(56) References Cited

U.S. PATENT DOCUMENTS

| | | | | | |
|---|---|---|---|---|---|
| 2,635,648 | A * | 4/1953 | Foster | 428/175 |
| 2,757,434 | A * | 8/1956 | McCord et al. | 28/156 |
| 4,022,596 | A * | 5/1977 | Pedersen | 55/528 |
| 4,943,334 | A * | 7/1990 | Medney et al. | 156/174 |
| 5,021,283 | A * | 6/1991 | Takenaka et al. | 428/116 |
| 5,037,691 | A * | 8/1991 | Medney et al. | 428/137 |
| 5,567,087 | A * | 10/1996 | Theisen | 405/302.7 |
| 5,616,399 | A * | 4/1997 | Theisen | 428/175 |
| 6,432,138 | B1 * | 8/2002 | Offray et al. | 623/8 |
| 7,114,186 | B2 * | 10/2006 | Steeghs et al. | 2/2.5 |
| 8,043,689 | B2 * | 10/2011 | Weiser | 428/175 |
| 8,342,213 | B2 * | 1/2013 | Sutton et al. | 139/384 R |
| 8,747,995 | B2 * | 6/2014 | Weiser | 428/175 |
| 2001/0046600 | A1 * | 11/2001 | Hsiao et al. | 428/365 |
| 2002/0058140 | A1 * | 5/2002 | Dana et al. | 428/375 |
| 2003/0037361 | A1 * | 2/2003 | Steeghs et al. | 2/2.5 |
| 2004/0131221 | A1 * | 7/2004 | Takayama et al. | 381/398 |
| 2005/0085147 | A1 * | 4/2005 | Homma et al. | 442/218 |
| 2005/0287343 | A1 * | 12/2005 | Weiser | 428/175 |
| 2006/0134389 | A1 * | 6/2006 | Weiser | 428/175 |
| 2006/0189236 | A1 * | 8/2006 | Davis et al. | 442/136 |
| 2006/0281382 | A1 * | 12/2006 | Karayianni et al. | 442/181 |
| 2007/0066171 | A1 * | 3/2007 | Bystricky et al. | 442/186 |
| 2010/0116530 | A1 * | 5/2010 | Okazaki | 174/257 |
| 2011/0027540 | A1 * | 2/2011 | Sutton et al. | 428/175 |
| 2011/0052910 | A1 * | 3/2011 | Gunnink et al. | 428/337 |
| 2013/0180765 | A1 * | 7/2013 | Aoshima et al. | 174/255 |
| 2014/0174632 | A1 * | 6/2014 | Roman et al. | 156/87 |

* cited by examiner

*Primary Examiner* — Bobby Muromoto, Jr.

(74) *Attorney, Agent, or Firm* — Pai Patent & Trademark Law Firm; Chao-Chang David Pai

(57) ABSTRACT

An X weave of composite material has multiple latitudinal fibers, multiple longitudinal fibers, and a woven center. Each longitudinal fiber is layered on two of the latitudinal fibers and then is woven through and layered under two of the latitudinal fibers. The longitudinal fibers are each woven by shifting in relative alignment position from one of the latitudinal fibers sequentially and woven radially with respect to the woven center, such that the longitudinal fibers form an X woven structure. Therefore, the intensity of the X weave can be enhanced by the X woven structure.

8 Claims, 7 Drawing Sheets

X WEAVE OF COMPOSITE MATERIAL AND METHOD OF WEAVING THEREOF

BACKGROUND OF THE INVENTION

1. Field of the Invention

The present invention relates to a woven product, especially to an X weave of composite material and method of weaving thereof.

2. Description of Related Art

Generally, weave of composite material may be made of carbon fibers, glass fibers, aramid fibers, or other high toughness fibers, and include plain weave, unidirectional weave, or multidirectional weave. The weave of composite material is widely applied for the cases of portable electronic products to provide protection.

With reference to FIG. 5, a plain weave 50 comprises multiple longitudinal fibers 51 and multiple latitudinal fibers 52. The longitudinal fibers 51 and the latitudinal fibers 52 are interwoven mutually and perpendicularly to form a one-layer structure. The plain weave 50 has a low production cost, but the intensity of the plain weave 50 is low, such that multiple plain weaves 50 have to be stacked and combined with each other to maintain a high intensity. When multiple plain weaves 50 are stacked and combined with each other, warping easily occurs on the stacked plain weaves 50.

With reference to FIG. 6, a unidirectional weave 60 comprises multiple fibers 61. The fibers 61 are arranged and woven in the same direction to form a one-layer structure, such that the intensity of the unidirectional weave 60 is low. Multiple fixing lines 62 are mounted on the fibers 61 to fix the fibers 61, or the fibers 61 are impregnated with resins to reinforce the structure of the unidirectional weave 60. After reinforcement by the fixing lines 62 or resins, the intensity of the unidirectional weave 60 is still low, such that multiple unidirectional weaves 60 have to be stacked and combined with each other to maintain a high intensity. Nevertheless, warping easily occurs on the appearance of the stacked unidirectional weaves 60.

With reference to FIG. 7, a multidirectional weave 70 comprises multiple first fibers 71 and multiple second fibers 72. The first fibers 71 and the second fibers 72 are stacked and woven at plus and minus 45 degrees or other angle degrees to form a two-layer structure. Multiple fixing lines 73 are mounted on the first fibers 71 and the second fibers 72 to fix the first fibers 71 and the second fibers 72. Warping hardly occurs on the multidirectional weave 70 because the first fibers 71 and the second fibers 72 are woven in multiple directions. Yet the drawback is the multidirectional weave 70 has a high production cost.

Current market demands for a portable electronic product include low cost, slim thickness, and high intensity. The costs of the plain weave 50 and the unidirectional weave 60 are low respectively, and the stacked plain weaves 50 and the stacked unidirectional weaves 60 both have high intensity. However, warping easily appears on the stacked plain weaves 50 and the stacked unidirectional weaves 60. The stacked plain weaves 50 and the stacked unidirectional weaves 60 have large thickness, such that adjusting the thickness to meet the demand of slimness for the portable electronic product is difficult. The multidirectional weave 70 has little warping, but the cost of the multidirectional weave 70 is high. Therefore, the plain weave 50, the unidirectional weave 60, and the multidirectional weave 70 are all inadequate to meet the current demands for the portable electronic product.

SUMMARY OF THE INVENTION

The main object of the present invention is to provide an X weave of composite material and a method of weaving the X weave.

The X weave of composite material in accordance with the present invention comprises multiple latitudinal fibers adjacently arranged in a horizontal direction, multiple longitudinal fibers adjacently arranged in a longitudinal direction relative to the latitudinal fibers, and at least one woven center.

Each longitudinal fiber is layered on at least two of the latitudinal fibers and then is woven through and layered under at least two of the latitudinal fibers, and the longitudinal fibers are each woven by shifting in relative alignment position from at least one of the latitudinal fibers sequentially, and are woven radially with respect to the at least one woven center.

The method of weaving the X weave of composite material comprises preparing multiple latitudinal fibers and multiple longitudinal fibers, arranging the latitudinal fibers adjacently in a horizontal direction, and weaving the longitudinal fibers to inter-layer with the latitudinal fibers and to form an X woven structure with respect to a woven center.

The X weave is woven by arranging each longitudinal fiber, skipping at least two latitudinal fibers sequentially, to be layered under and on the latitudinal fibers, and the longitudinal fibers are each shifted in relative alignment position from at least one latitudinal fiber respectively and sequentially to form the X woven structure with the woven center.

The longitudinal fibers are woven radially with respect to the woven center, such that the elasticity and the intensity of the X weave can be enhanced by the X woven structure and the woven center. Therefore, the X weave does not need to be layered with another weave to increase the intensity. Stress concentration and warping hardly occur on the X weave. As the X weave is woven by controlling the longitudinal fibers only, the manufacturing cost of the X weave is relatively low. Therefore, the X weave can meet the demands for the portable electronic products easily.

DETAILED DESCRIPTION OF PREFERRED EMBODIMENT

Figure 1:
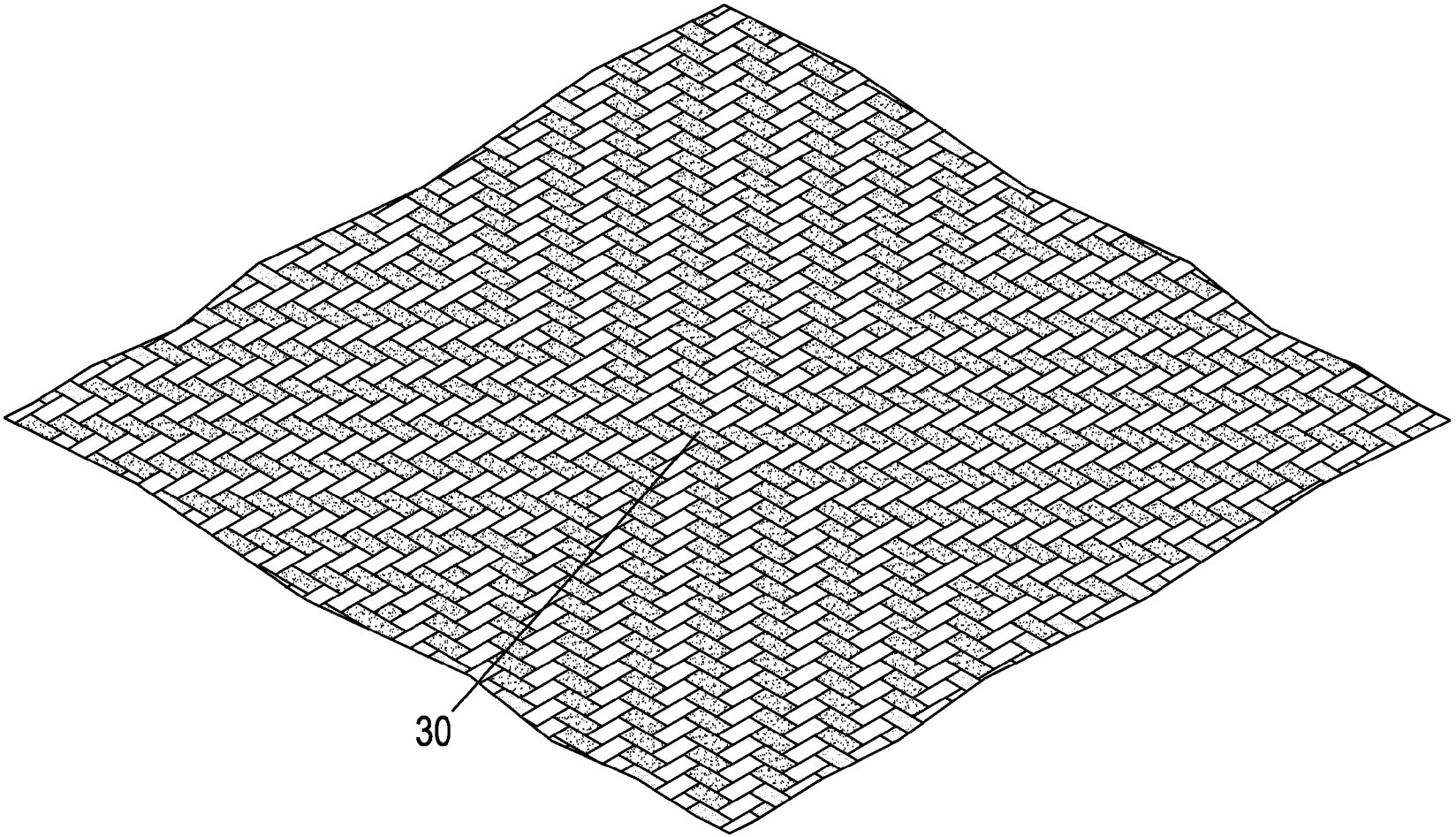
FIG. 1 is a perspective view of a first preferred embodiment of an X weave of composite material in accordance with the present invention.
Figure 2:
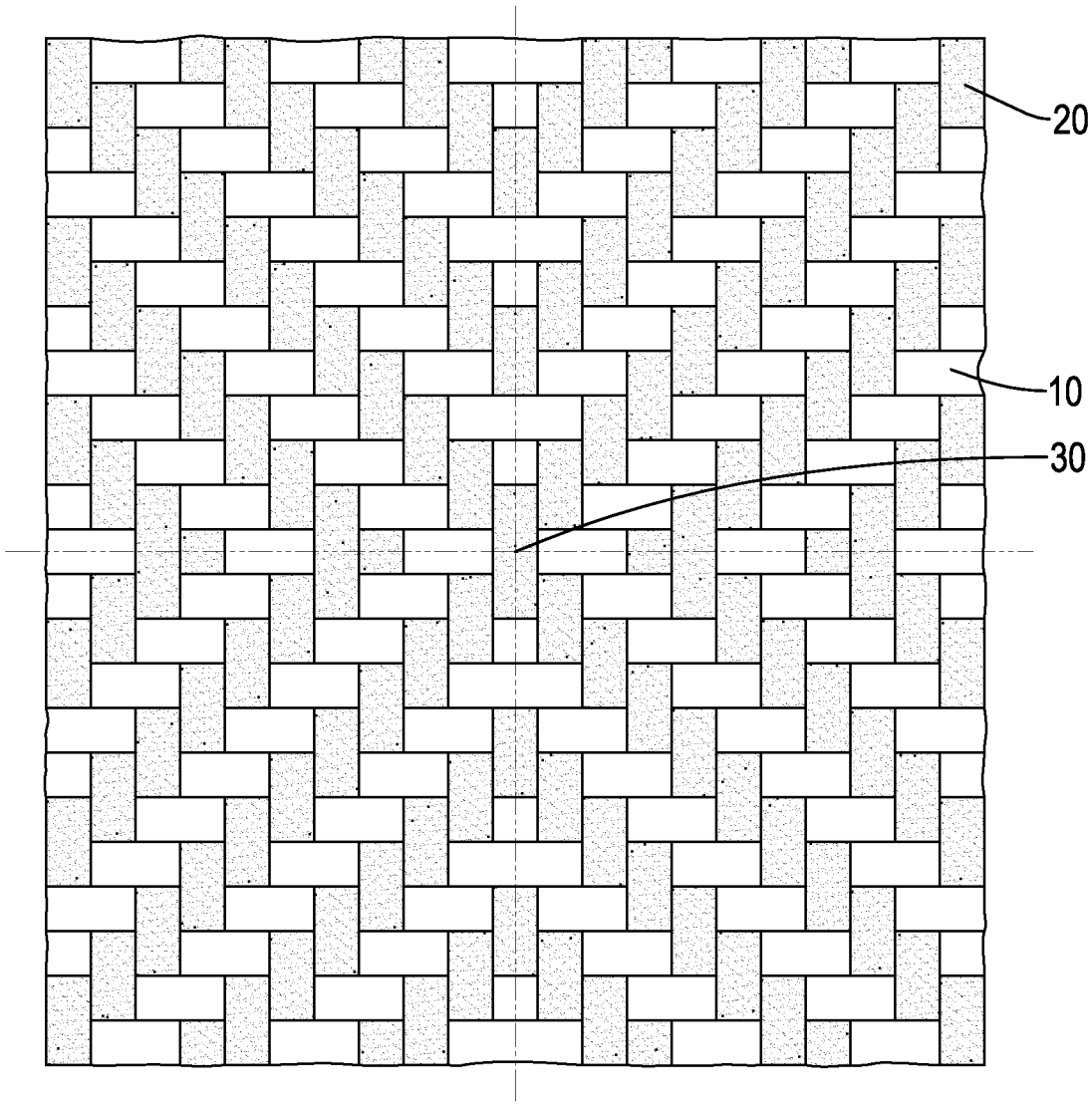
FIG. 2 is an enlarged front view of the X weave of composite material in FIG. 1.

With reference to FIG. 1 and FIG. 2, a preferred embodiment of an X weave of composite material in accordance with the present invention has multiple latitudinal fibers 10 and multiple longitudinal fibers 20.

The latitudinal fibers 10 are adjacently arranged in a horizontal direction and the longitudinal fibers 20 are adjacently arranged in a longitudinal direction relative to the latitudinal fibers 10. Each latitudinal fiber 10 is layered on two of the latitudinal fibers 20 and then is woven through and layered under two of the latitudinal fibers 20 to be inter-layered with the latitudinal fibers 20. The longitudinal fibers 20 are woven to form an X-shaped woven structure with respect to the woven center 30, which means the longitudinal fibers 20 are woven by shifting in relative alignment position from one of the latitudinal fibers 10 sequentially, and are woven radially with respect to the woven center 30.

Figure 3:
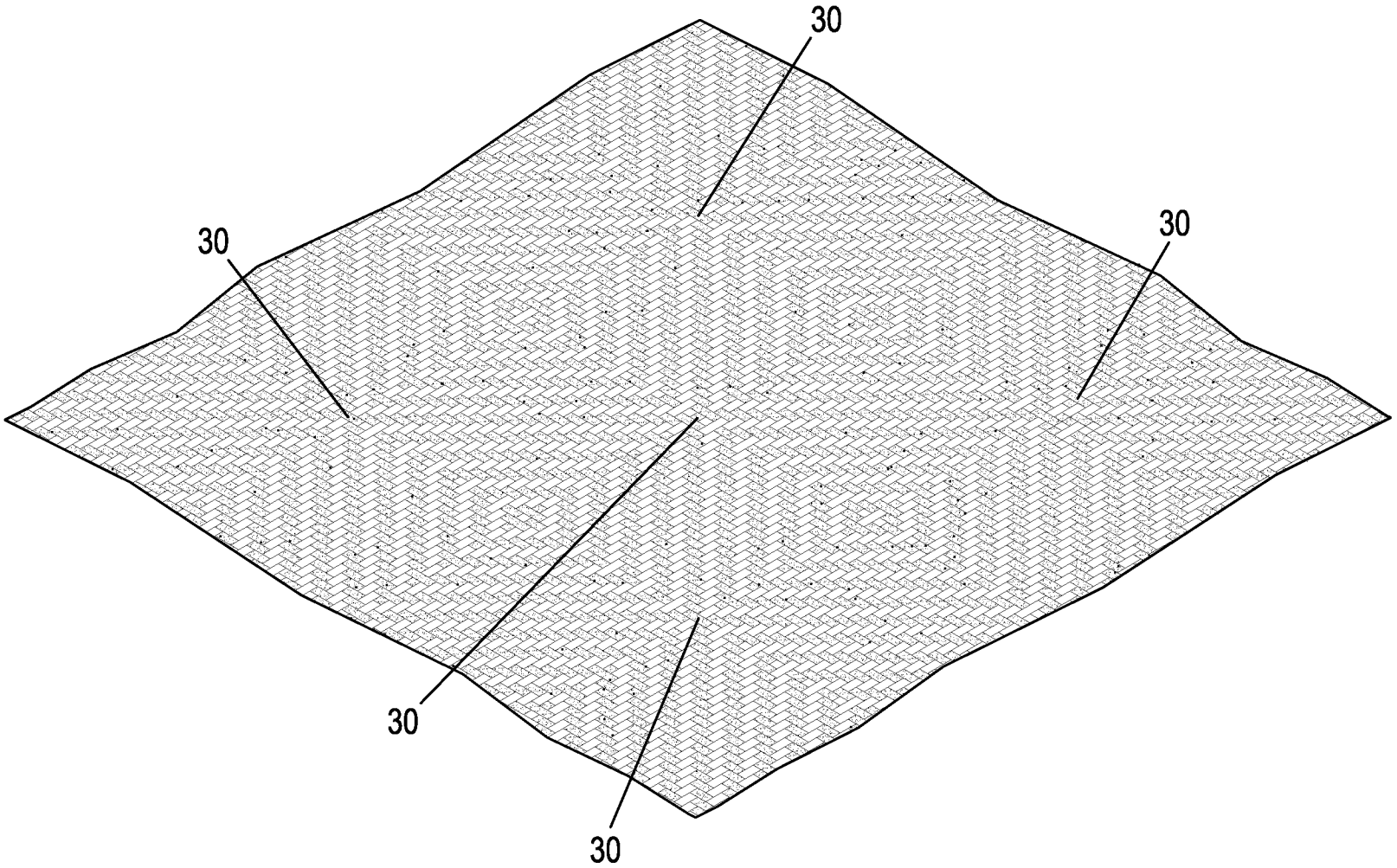
FIG. 3 is a perspective view of a second preferred embodiment of the X weave of composite material in accordance with the present invention.

With reference to FIG. 3, the X weave may be woven to form multiple woven centers 30. For example, the X weave is woven to form five woven centers 30, such that the X weave forms five X-shaped woven structure. The five woven centers 30 and the five X-shaped structures can enhance the intensity of the X weave.

The X weave may be woven by different fibers to adjust the intensity of the X weave to meet different demands for different portable electronic products. For example, the X weave may be woven by carbon fibers, glass fibers, aramid fibers or the other fibers.

Figure 4:
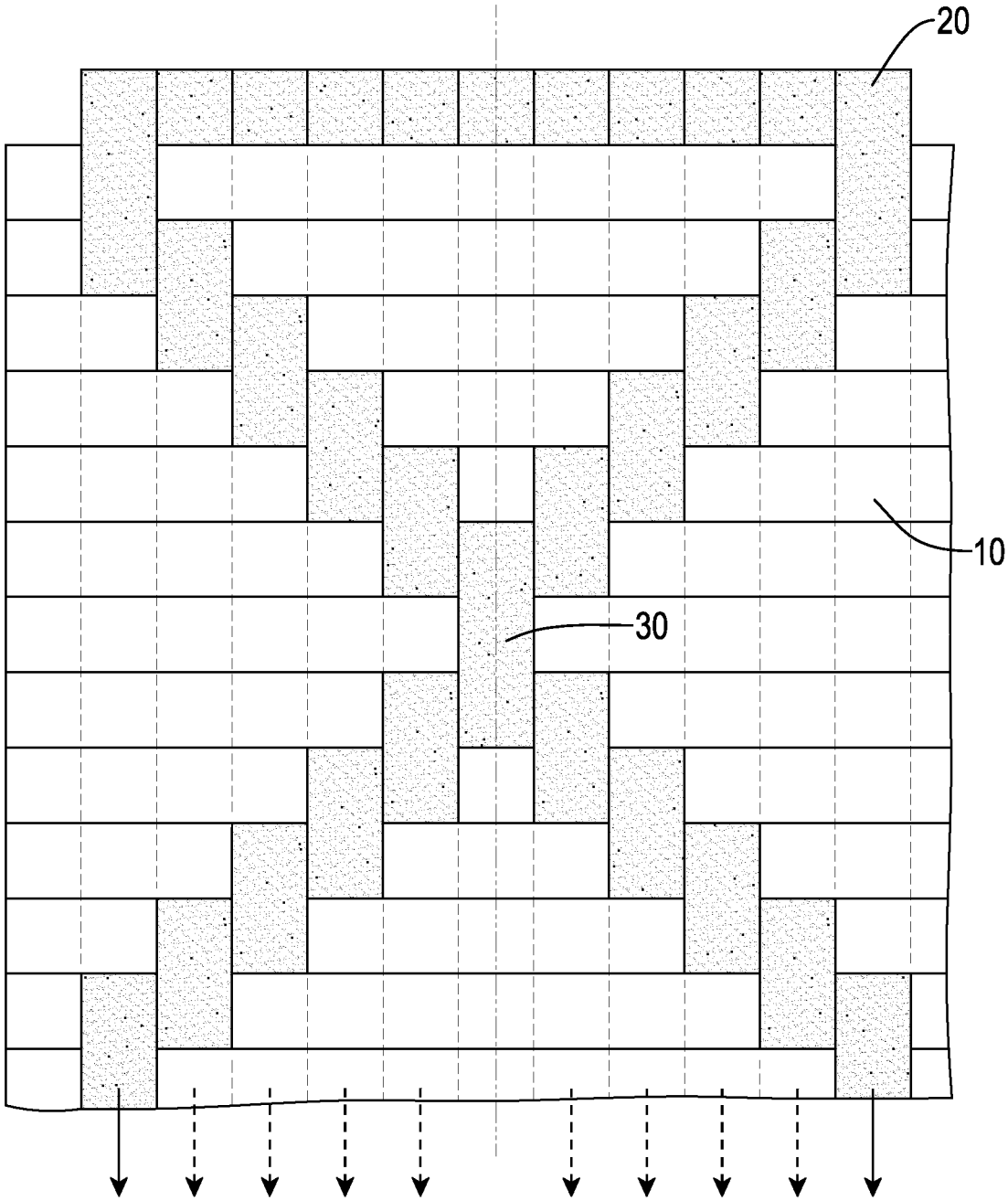
FIG. 4 is a woven diagram of the X weave of composite material in accordance with the present invention.
Figure 5:
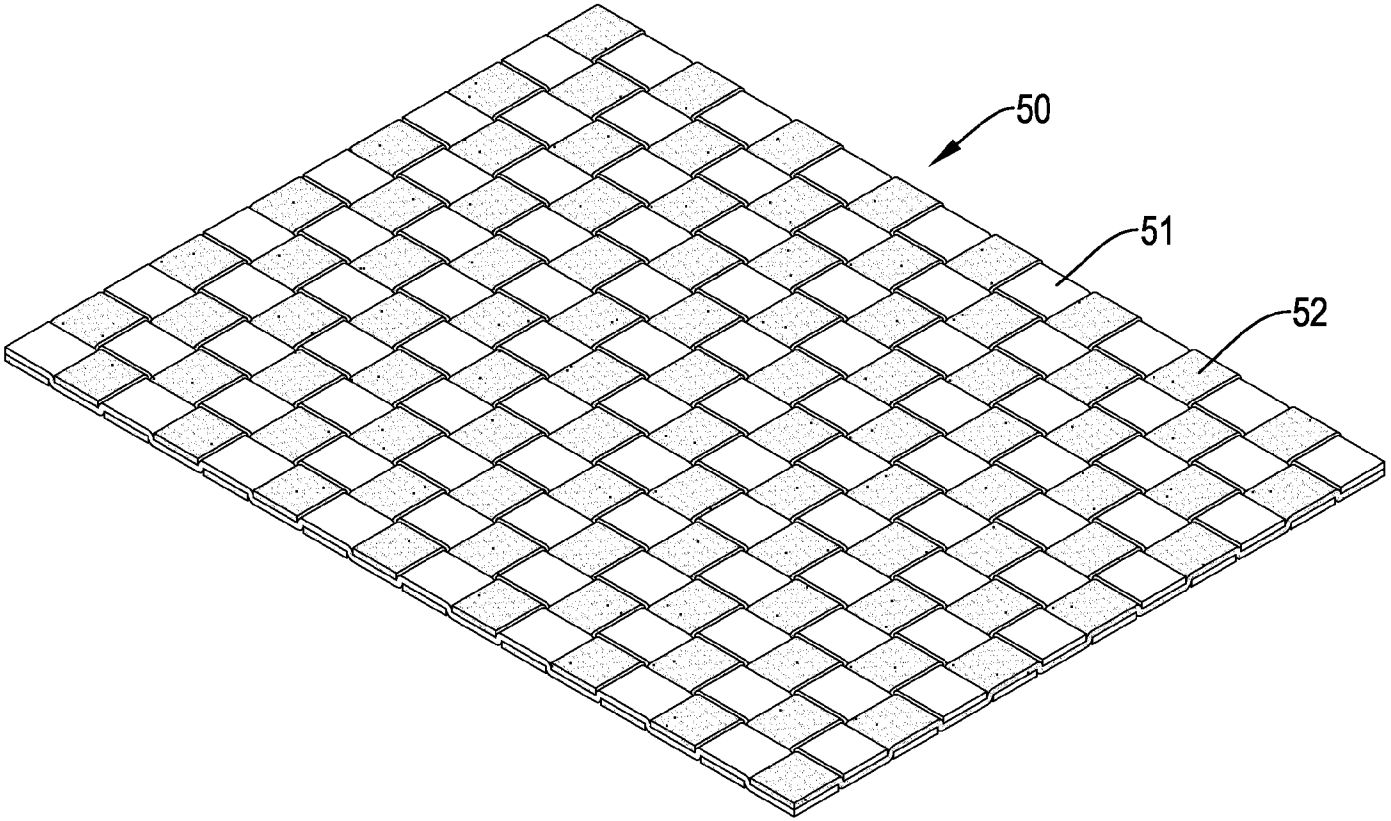
FIG.5 PRIOR ART
FIG. 5 is a perspective view of a conventional plain weave.
Figure 6:
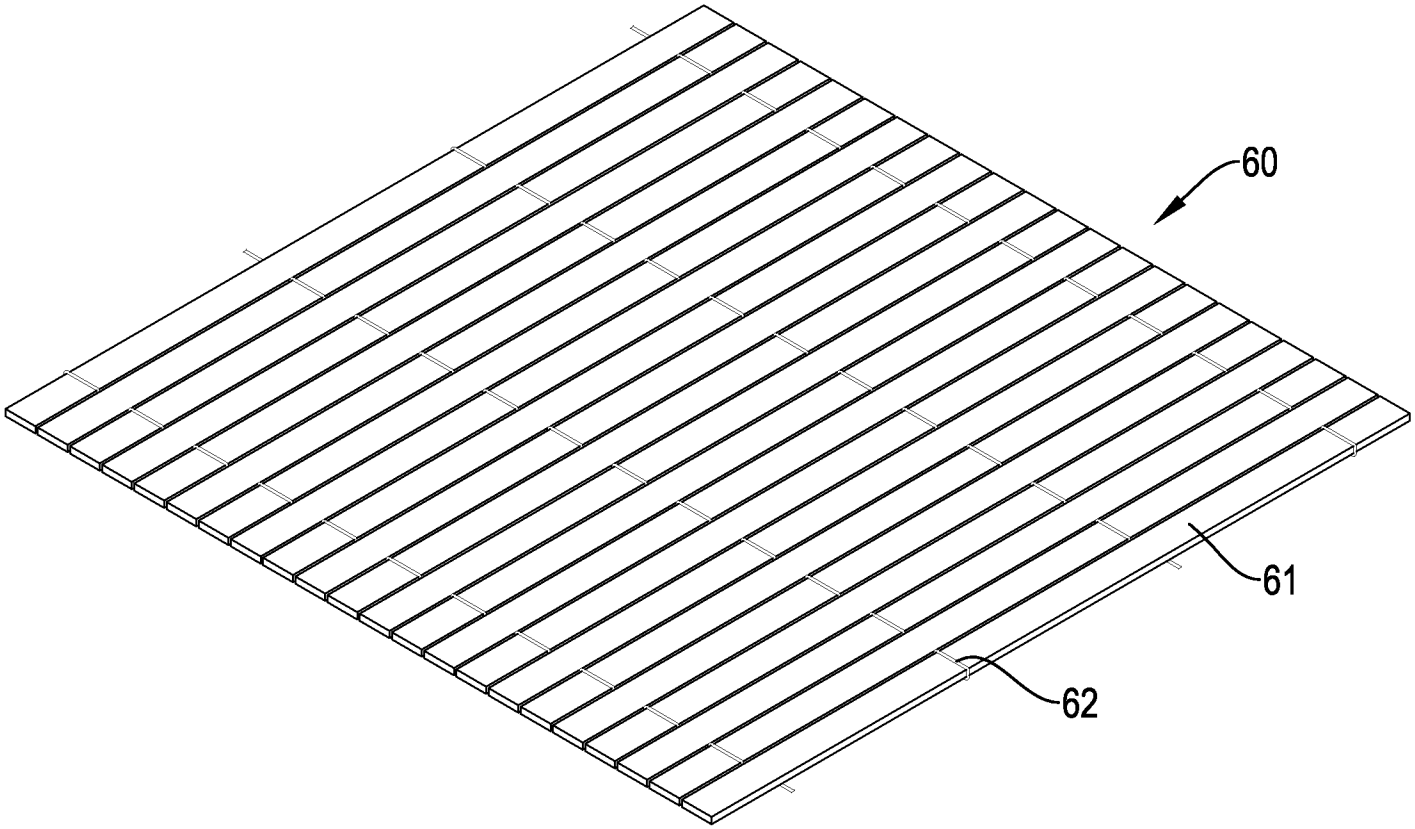
FIG.6 PRIOR ART
FIG. 6 is a perspective view of a conventional unidirectional weave.
Figure 7:
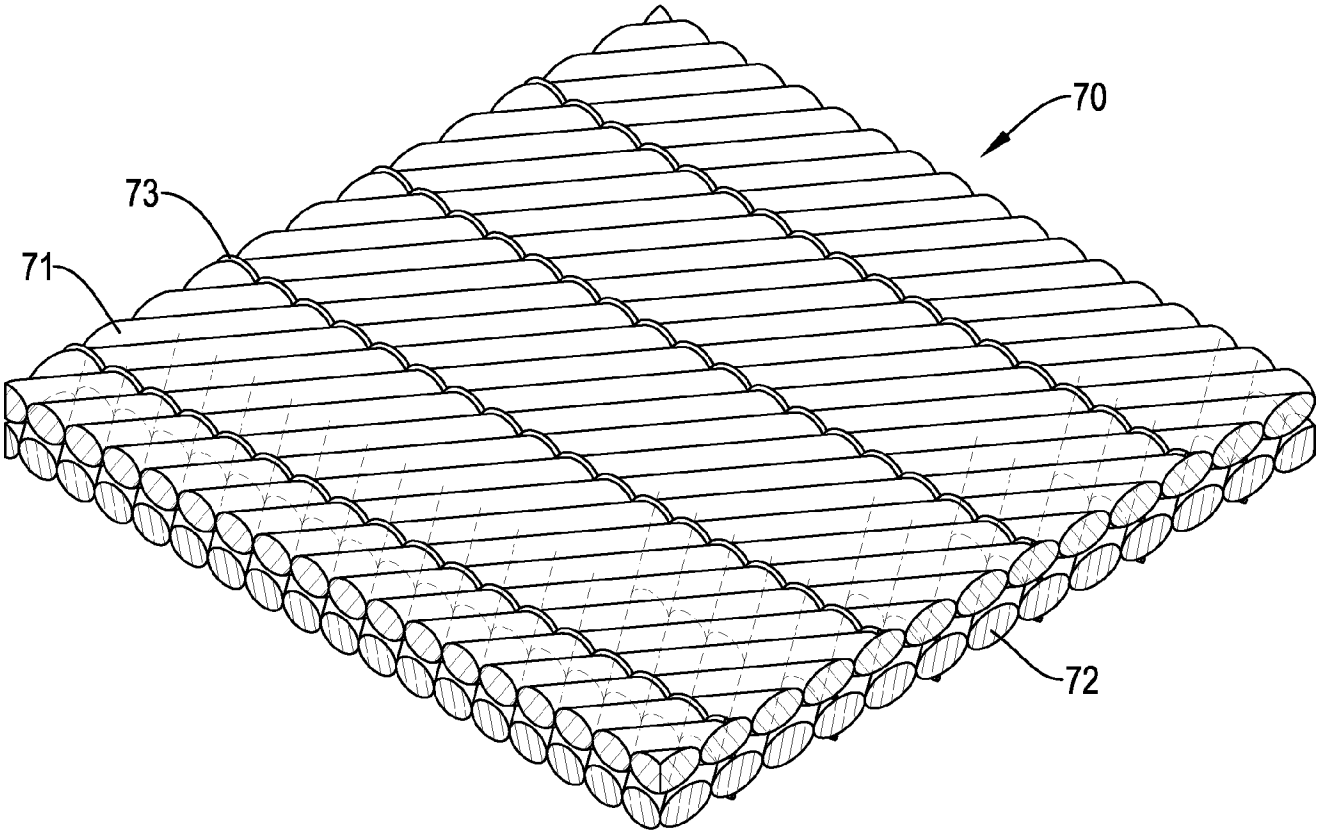
FIG.7 PRIOR ART
FIG. 7 is a perspective view of a conventional multidirectional weave.

With reference to FIG. 4, the method of weaving the X weave of composite material of the present invention comprises: preparing multiple latitudinal fibers and multiple longitudinal fibers, arranging the latitudinal fibers adjacently in a horizontal direction, and weaving the longitudinal fibers to inter-layer with the latitudinal fibers and to form an X woven structure with respect to a woven center.

The X weave is woven by arranging each longitudinal fiber, skipping two latitudinal fibers sequentially, to be layered under and on the multiple latitudinal fibers. The longitudinal fibers are each shifted in relative alignment position from a latitudinal fiber respectively and sequentially to form the X woven structure with the woven center.

Because the longitudinal fibers and the latitudinal fibers are woven longitudinally and horizontally respectively, the structure of the X weave is compact and reinforced. Woven radially from the woven center, the X weave as well as the woven center can both have enhanced intensity and elasticity. Therefore, stress concentration and warping hardly occur on the X weave of the present invention.

Because the intensity of the X weave is higher than the intensity of the conventional plain weave and the intensity of the conventional unidirectional weave, the X weave can achieve the same level of intensity with multiple conventional combined plain weaves and multiple conventional unidirectional weaves. The X weave of composite material of the present invention has a slim thickness. When the X weave is applied on a portable electronic product, the total thickness of the X weave and the electronic product is adjusted easily. On the other hand, as the X weave is woven by controlling the longitudinal fibers by a weaving board, the manufacturing cost of the X weave of composite material of the present invention is lower than the manufacturing cost of the conventional multidirectional weave.

What is claimed is:

1. An X weave of composite material comprising:

multiple latitudinal fibers adjacently arranged in a horizontal direction;

multiple longitudinal fibers adjacently arranged in a longitudinal direction relative to the latitudinal fibers; and at least one woven center, wherein each longitudinal fiber is layered on at least two of the latitudinal fibers and then woven through and layered under at least two of the latitudinal fibers, and the longitudinal fibers are each woven by shifting in relative alignment position from at least one of the latitudinal fibers sequentially, and are woven radially with respect to the at least one woven center.

2. The X weave of composite material as claimed in claim 1, wherein the longitudinal fibers and the latitudinal fibers are made of carbon fibers, glass fibers, or aramid fibers.

3. The X weave of composite material as claimed in claim 1, wherein each longitudinal fiber is layered on two of the latitudinal fibers and then is woven through and layered under two of the latitudinal fibers, and the longitudinal fibers are woven radially with respect to the woven center.

4. The X weave of composite material as claimed in claim 2, wherein each longitudinal fiber is layered on two of the latitudinal fibers and then is woven through and layered under two of the latitudinal fibers, and the longitudinal fibers are woven radially with respect to the woven center.

5. A method of weaving the X weave of composite material as claimed in claim 1 comprising:

preparing multiple latitudinal fibers and multiple longitudinal fibers;

arranging the latitudinal fibers adjacently in a horizontal direction; and weaving the longitudinal fibers to inter-layer with the latitudinal fibers and to form an X woven structure with respect to a woven center; wherein the X weave is woven by arranging each longitudinal fiber, skipping at least two latitudinal fibers sequentially, to be layered under and on the latitudinal fibers, and the longitudinal fibers are each shifted in relative alignment position from at least one latitudinal fiber respectively and sequentially to form the X woven structure with the woven center.

6. The method of weaving the X weave of composite material as claimed in claim 5, wherein each latitudinal fiber and each longitudinal fiber are made of carbon fibers, glass fibers, or aramid fibers.

7. The method of weaving the X weave of composite material as claimed in claim 5, wherein the X weave is woven by arranging each longitudinal fiber, skipping two latitudinal fibers sequentially, to be layered under and on the latitudinal fibers, and the longitudinal fibers are each shifted in relative alignment position from a latitudinal fiber respectively and sequentially.

8. The method of weaving the X weave of composite material as claimed in claim 6, wherein the X weave is woven by arranging each longitudinal fiber, skipping two latitudinal fibers sequentially, to be layered under and on the latitudinal fibers, and the longitudinal fibers are each shifted in relative alignment position from a latitudinal fiber respectively and sequentially.

* * * * *